United States Patent [19]

Seynhaeve

[11] Patent Number: 5,003,671

[45] Date of Patent: Apr. 2, 1991

[54] DEVICE FOR AFFIXING THE STRAPS OF ARTICLES OF LUGGAGE

[75] Inventor: Andre Seynhaeve, Senlis, France

[73] Assignee: Delsey S. A., Bobigny, France

[21] Appl. No.: 459,994

[22] Filed: Jan. 4, 1990

[30] Foreign Application Priority Data

Jan. 11, 1989 [FR] France ..... 89 00257

[51] Int. Cl.[5] ..... A44C 5/18

[52] U.S. Cl. ..... 24/265 A; 24/265 R; 190/119

[58] Field of Search ..... 24/265 A, 265 R; 119/118, 119, 120; 150/118

[56] References Cited

U.S. PATENT DOCUMENTS

| | | | |
|---|---|---|---|
| 438,051 | 10/1890 | Bernstein | 24/265 A |
| 943,135 | 12/1909 | Boyer | 24/265 A |
| 2,087,615 | 7/1937 | Carr | 150/118 |
| 2,223,420 | 12/1940 | Holden | 24/265 A |
| 2,415,220 | 2/1947 | Ritter | 190/119 |
| 3,094,757 | 6/1963 | Blake | 24/265 R |
| 3,139,164 | 6/1964 | Koffler | 190/119 |
| 3,279,512 | 10/1966 | Paynor | 24/265 A |
| 3,323,184 | 6/1967 | Reiter | 24/265 A |
| 3,967,708 | 7/1976 | Gregg et al. | 190/119 |

*Primary Examiner*—Victor N. Sakran

*Attorney, Agent, or Firm*—Finnegan, Henderson, Farabow, Garrett & Dunner

[57] ABSTRACT

Device for affixing the extremities of elastic straps to the interior lining of an article of luggage, said strap used for compacting clothing tightly together.

Each extremity of the strap (1, 2) is fixed by a plaque (5), said plaque provided with two lateral edges, said edges provided with notches (6) that are pushed in by force into the corresponding lodgings to which they are coupled within the lining of the article of luggage.

7 Claims, 2 Drawing Sheets

DEVICE FOR AFFIXING THE STRAPS OF ARTICLES OF LUGGAGE

It is known that straps used for condensing clothing are disposed in the base of an article of luggage with the aim that clothing be tightly brought together at the moment the article of luggage is lifted.

It is, in particular, known that two elastic straps in a V form are attached to each other by buckles, each buckle placed at the converging point of the V.

This invention concerns this sort of strap and more particularly the means meant to facilitate the way these straps are set up within the hulls of rigid or semirigid articles of luggage.

Figure 1:
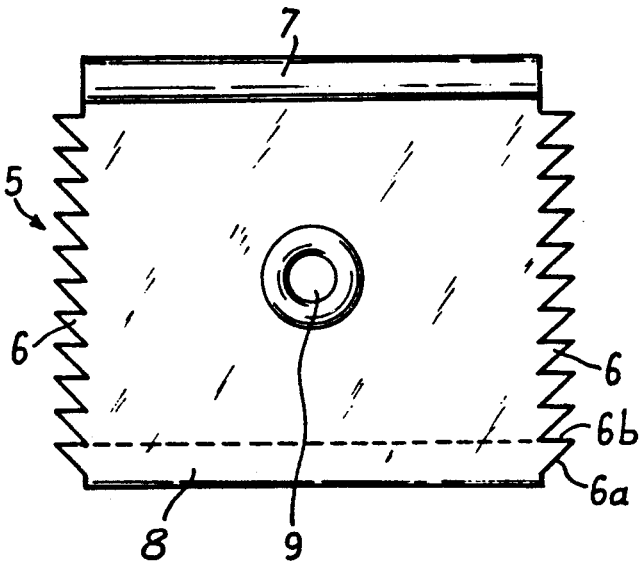

For example, and to facilitate the understanding of this invention, this invention is represented by appended designs:

FIG. 1, a front view of a piece of metal hitching in the fashion of the invention.

Figure 2:
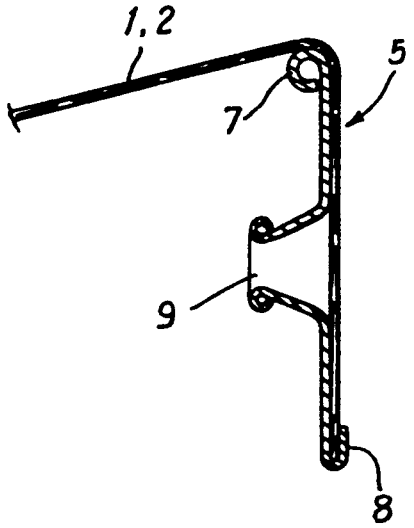
Figure 3:
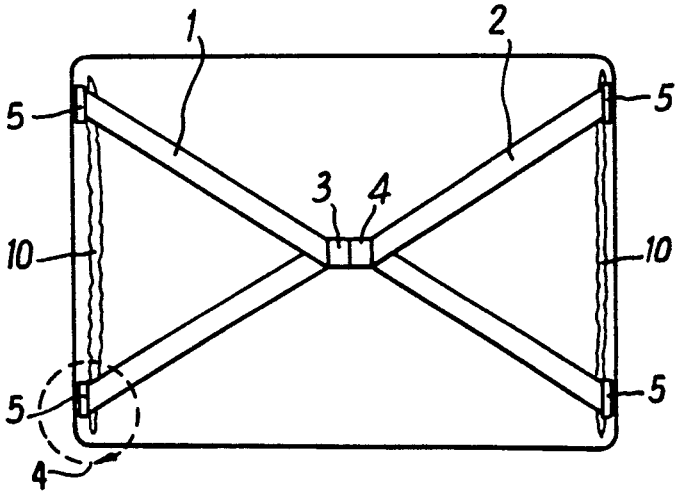
Figure 4:
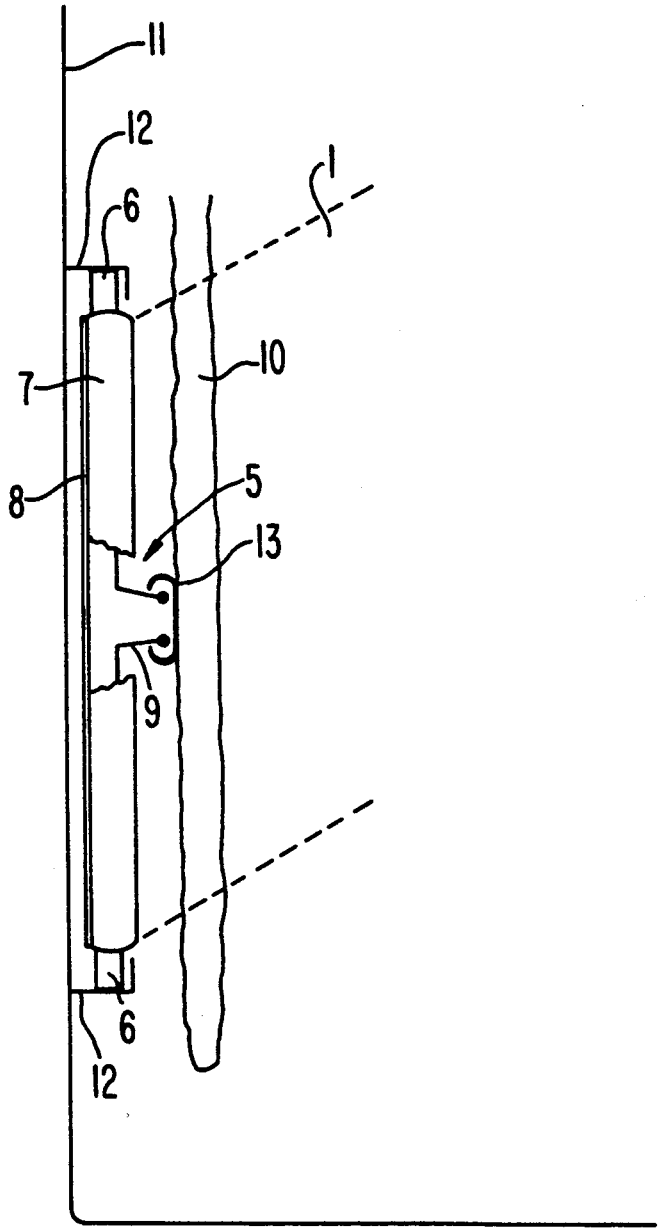

FIG. 2, a side-view of the piece mentioned in FIG. 1,

FIG. 3, a level-view on a smaller scale illustrating the positioning of the buckles in the hull of an article of luggage, said positioning using means of the devices in FIGS. 1 and 2. FIG. 4 is an enlarged, partially cut-away, plan view of the portion of FIG. 3 encircled by line IV.

FIG. 3 represents 2 elastic straps 1 and 2, arrayed in a V form and each one being fortified at the converging point of that V by buckles 3 and 4 which permit the straps to be fixed one to the other.

In the case of an article of luggage made firm by rigid or semirigid plastic obtained through injection or through thermal molding, the extremities of the straps are fixed to the internal lining of the hull by means of rivets. This sort of riveting can be seen on the exterior. It is inaesthetic and is necessary for the attachment of embellishments that increase the cost of production. What's more, the straps frequently tear apart from around these rivets.

According to this invention, each branch of the V of strap 1 and 2 is attached to the interior lining 11 by means of a special plate 5, represented in detail in FIGS. 1, 2 and 4. Each plate 5 is made of a piece of metal, which is preferable but not obligatory. This plate is sensibly rectangular so that the two lateral edges can be provided with teeth 6. Each tooth 6 is given a form in such a way that the lower edge 6*a* is slanting and the higher edge 6*b* is horizontal. This format allows plate 5 to be pushed by force into a rectangular bracket 12 of a corresponding dimension that is joined to the lining 17 of the hull of the article of luggage. The teeth 6 can be pushed into the bracket 12, but they can not come out again.

Preferably plate 5 bears a cylindrical roller 7 on its upper part on which straps 1 and 2 coil, one that avoids any risk of shearing the straps. This cylindrical roller 7 may be obtained by rolling the higher edge of plate 5 back onto itself.

At its lower part, plate 5 is bent back on itself to an angle of 180° as represented in 8. This bending allows the pinching of the extremity of strap 1 or 2 and therefore also allows that extremity to be clutched across its breadth.

Of equal preference, plate 5 bears at least one teat or male portion 9 used for a snap, said teat meant to receive the upper part or female portion 13 of a snap and female portion 13 being positioned on a soft pocket 10 (FIG. 4).

As there are two plate 5 on each side of the hull, this permits each soft pocket 10 to be affixed by means of two snaps, and therefore to open and easily re-close the pockets at the time the article of luggage is being filled or emptied.

What is claimed is:

1. In an article of luggage having a peripheral lining defining a cavity for containing clothing and the like and including elastic straps selectively connected across the cavity for securing the clothing therein, an improved device for securing one end of a strap to the lining, the device comprising:

a generally planar plate having top, bottom and opposed side edges, each side edge including a plurality of spaced teeth extending in the plane of the plate;

a bracket fixed tot he lining and defining a space for fixedly receiving the plate, the bracket including opposed walls disposed to be engaged by the teeth on inserting the plate into the bracket; and means on the plate for fixing the one end of the strap thereto.

2. The device of claim 1 wherein each said tooth has an upper edge extending rom the respective side edge generally parallel to he bottom edge of the plate and a lower edge extending from the respective side edge at an acute angle to the bottom edge of the plate, the orientation of the tooth edges facilitating insertion of the plate into the bracket and resisting removal of the plate therefrom.

3. The device of claim 1 wherein the fixing means comprises a flange extending from the bottom edge bent toward the plate to clamp the one end of the strap between the flange and the plate.

4. The device of claim 1 also including a rounded flange extending from the top edge of the plate, the rounded flange disposed to support a portion of the strap thereon.

5. The device of claim 1 also including the male portion of a snap extending from the plate at a portion thereof between the edges thereof.

6. In an article of luggage having a peripheral lining defining a cavity for containing clothing and the like and including elastic straps selectively connected across the cavity for securing the clothing therein and flexible pockets removably fixable to the lining, an improved device for securing one end of the strap to the lining, the device comprising:

a generally planar plate having top, bottom and opposed side edges, each side edge including a plurality of spaced teeth extending in the plane of the plate, each said tooth having an upper edge extending from the respective side edge generally parallel to the bottom edge of the plate and a lower edge extending from the respective side edge at an acute angle to the bottom edge of the plate;

a bracket fixed to the lining and defining a space for fixedly receiving the plate, the bracket including opposed walls disposed to be engaged by the teeth on inserting the plate into the bracket; and means on the plate for fixing the one end of the strap thereto.

7. The device of claim 6 also including a snap structure for removably fixing a pocket to the plate including a male portion of the snap extending from the plate and the corresponding female portion of the snap being fixed to the pocket.

* * * * *

UNITED STATES PATENT AND TRADEMARK OFFICE

CERTIFICATE OF CORRECTION

PATENT NO. : 5,003,671

DATED : April 2, 1991

INVENTOR(S) : Andre Seynhaeve

It is certified that error appears in the above-identified patent and that said Letters Patent is hereby corrected as shown below:

IN THE CLAIMS:

Column 2, line 17, change "tot he" to --to the--;
line 24, change "rom" to --from--;
line 25, change "he" to --the--.
line 47, change "the" (first occurrence) to --a--.

TITLE PAGE

IN THE ABSTRACT:

The abstract should be deleted in its entirety and the following paragraph substituted therefor:

> In an article of luggage having a peripheral lining defining a cavity for containing clothing and the like and including elastic straps selectively connected across the cavity for securing the clothing therein, an improved device for securing one end of a strap to the lining comprising a generally planar plate having top, bottom and opposed side edges, each side edge including a plurality of spaced teeth extending in the plane of the plate, a bracket fixed to the lining and defining a space for fixedly receiving the plate, the bracket including opposed walls disposed to be engaged by the teeth on inserting the plate into the bracket, and a bent flange for clampingly

UNITED STATES PATENT AND TRADEMARK OFFICE

CERTIFICATE OF CORRECTION

PATENT NO. : 5,003,671

DATED : April 2, 1991

INVENTOR(S) : Andre Seynhaeve

It is certified that error appears in the above-identified patent and that said Letters Patent is hereby corrected as shown below:

fixing the one of the strap to the plate.

Signed and Sealed this

Eleventh Day of August, 1992

*Attest:*

DOUGLAS B. COMER

*Attesting Officer*

*Acting Commissioner of Patents and Trademarks*